US008047423B1

(12) United States Patent
Brecht

(10) Patent No.: US 8,047,423 B1
(45) Date of Patent: Nov. 1, 2011

(54) SWING AWAY MAILBOX SUPPORT

(76) Inventor: Robert H. Brecht, Bratenahl, OH (US)

( * ) Notice: Subject to any disclaimer, the term of this patent is extended or adjusted under 35 U.S.C. 154(b) by 0 days.

(21) Appl. No.: 13/089,607

(22) Filed: Apr. 19, 2011

Related U.S. Application Data

(60) Provisional application No. 61/326,305, filed on Apr. 21, 2010.

(51) Int. Cl.
*A47G 29/12* (2006.01)

(52) U.S. Cl. ..... 232/39; 248/131; 248/145

(58) Field of Classification Search ..... 232/39; 248/131, 145, 415–418, 219.2, 349.1, 156; D99/32
See application file for complete search history.

(56) References Cited

U.S. PATENT DOCUMENTS 3,161,397 A * 12/1964 Nolander ..... 248/417
3,229,940 A 1/1966 Kagels
3,407,997 A 10/1968 Wood
3,870,262 A 3/1975 Manning et al.
4,172,579 A * 10/1979 Steinman ..... 248/145
4,484,705 A 11/1984 Sande
4,667,918 A 5/1987 Page
4,893,747 A 1/1990 Roth
5,167,364 A 12/1992 Wenning
5,400,958 A * 3/1995 Walker ..... 232/39
5,450,303 A 9/1995 Markiewicz et al.
5,458,286 A * 10/1995 Paschal ..... 232/39
5,622,343 A * 4/1997 Morton ..... 248/131
5,779,202 A 7/1998 Black
6,662,997 B1 * 12/2003 Smith et al. ..... 232/39
7,070,090 B2 7/2006 Ranen
7,249,704 B1 * 7/2007 Smith ..... 232/39
7,559,457 B2 * 7/2009 Webber ..... 232/39

* cited by examiner

*Primary Examiner* — William L. Miller
(74) *Attorney, Agent, or Firm* — Pearne & Gordon LLP

(57) ABSTRACT

A swing away or pivotable mailbox support includes a lower post anchored in the ground and pivotally connected to an upper post having a horizontally projecting mailbox support arm. The upper post is pivotally movable in response to horizontal loads applied to the support arm. Adjacent connecting ends of the posts have aligned centrally located mounting bores for receipt of a mounting shaft. A bearing and detent assembly is mounted to the connecting ends of the posts to provide support and relative rotational movement between detent-engaged stable rotational positions. A kit including a bearing and detent assembly and a shaft is also provided for converting a stationary mailbox support to a swing away or pivotable support in accordance with the invention.

20 Claims, 6 Drawing Sheets

SWING AWAY MAILBOX SUPPORT

This application claims the priority of U.S. Provisional Application No. 61/326,305, filed Apr. 21, 2010.

BACKGROUND OF THE INVENTION AND PRIOR ART

The invention relates to mailbox support apparatus and, more particularly, to a roadside mailbox support arrangement wherein the mailbox support arm assembly pivots about a vertical axis and swings away from loads as may be applied by snow plowing or vandals. The invention also relates to a kit for conversion of a stationary mailbox support to include a swing away or pivotable mailbox support arm assembly. The kit includes the hardware required for conversion of a wood post system.

SUMMARY OF THE INVENTION

In accordance with the invention, a vertical post is provided with aligned vertical post sections arranged for relative rotation. In the illustrated embodiment, the upper post section is arranged for swing away or pivotal movement relative to the bottom post section.

The adjacent connecting ends of the posts include centrally extending mounting bores that are aligned in the assembled post arrangement for receipt of a shaft. The shaft serves to maintain post-alignment and to allow for the pivotable or swing away movement.

A bearing and detent assembly is secured to the connecting ends of the posts. The assembly provides bearing wear and support surfaces between the ends of the posts. In addition, a detent is provided for temporarily fixing the rotational position of the upper post and mailbox support arm assembly relative to the lower post.

In an illustrated embodiment, the detent includes a projection in the form of a rounded rib on each side of the mounting bore on the end of one of the posts and a corresponding pair of recesses on the end of the other post. The rounded cross-section of the engaging elements provides a smooth cam function to disengage the detent upon swing away or rotation movement.

In another illustrated embodiment, the bearing and detent assembly includes bearing members mounted to adjacent connecting ends of the lower and upper posts. Each bearing member has a peripheral bearing portion surrounding a circular bearing portion. The peripheral bearing portion extends in a post plane parallel to the adjacent post connecting end and the circular portion extends in a cam plane that intersects the post plane at an angle. The circular portions have engageable cam faces. In a detent-engaged stable position tending to resist rotation, the circular portions are nested and the cam faces fully contact each other.

DETAILED DESCRIPTION OF THE DRAWINGS

Figure 3:
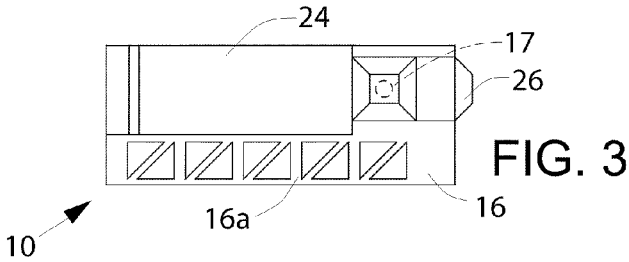
FIG. 3 is a top plan view of the mailbox support shown in FIG. 1.
Figure 1:
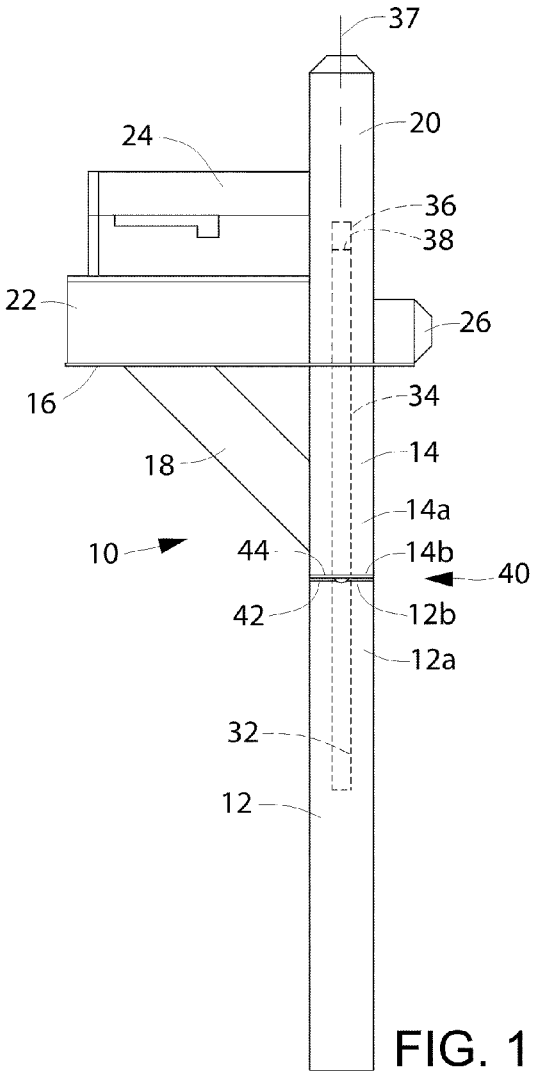
FIG. 1 is an elevational side view of a mailbox support including a lower post and an upper post joined for relative pivotal movement by a bearing and detent assembly in accordance with the invention.
Figure 2:
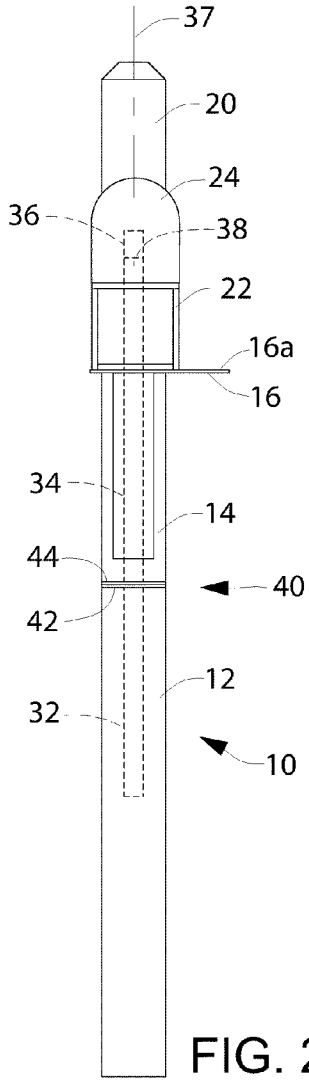
FIG. 2 is a front view of the mailbox support shown in FIG. 1.

Referring to FIGS. 1, 2 and 3, a mailbox support 10 includes a lower post 12 anchored in the ground and an upper post 14. A mailbox support arm and bumper 16 is mounted at a right angle to the upper post 14 by any convenient fastening means with further support provided by a brace 18. A top post 20 is mounted to the arm 16 and to the upper post 14 as described more fully below.

A newspaper box 22 is secured to the arm 16, and to the top post 20. A mailbox 24 is mounted to the top of the newspaper box 22 and to the top post 20. A back end cap 26 is fastened to the arm 16 and also to the top post 20 to provide a finished "post" appearance.

The posts 12, 14 and 20 are formed of 5½"×5½" lumber suitable for outdoor use. Of course, assembled wood constructions of similar size and/or other suitable materials or sizes may be used to form the posts. The brace 18 is also provided as a wood construction, but it may be formed of other materials.

The support arm 16 is formed of a ¼" thick steel plate that has an area larger than the base of the newspaper box. The arm 16 includes a projecting portion **16*a*** extending in the direction of oncoming traffic so as to serve as a bumper and provide a protective function.

A mounting bore 32 is axially disposed in the lower post 12 and aligned with a corresponding mounting bore 34 in the upper post 14. A similar mounting bore 36 is provided in the top post 20. The bores 32, 34 and 36 may comprise blind bores, through bores or any other type of construction that provides a suitably sized and aligned opening. The bores 32, 34 and 36 extend along the central axis 37 of the mounting posts 12, 14 and 20.

As shown, the bores 32, 34 and 36 are axially aligned when the mailbox support 10 is assembled. A shaft or tube 38 extends through the aligned bores 32, 34 and 36 in order to maintain the mounting of the upper posts 14 and 20 on the lower post 12. In addition, the arm 16 includes an opening 17 through which the shaft 38 extends for receipt in the bore 36 in the top post 20.

In the illustrated embodiment, a metal tube 38 is used to form the shaft. However, the shaft may be formed as a solid or a tube, and other construction materials such as wood or plastic may be used.

The bores 32, 34 and 36 are sized to permit rotation of the upper post 14 about the shaft 38. It is convenient to similarly size the bores 32, 34 and 36 for purposes of manufacture and assembly.

The lower post 12 extends to a connecting end 12*a* terminating at an end face 12*b*. Similarly, the upper post 14 extends to a connecting end 14*a* terminating at an end face 14*b*.

The connecting ends 12*a* and 14*a* are provided with a bearing and detent assembly 40. More particularly, a lower bearing member 42 is secured to the connecting end 12*a* and an upper bearing member 44 is secured to the connecting end 14*a*. The bearings 42 and 44 support the upper post 14 and provide the frictional contact upon rotation of the latter. To that end, the bearings 42 and 44 respectively cover substantially the entire end faces of the 12*b* of the post 12 and 14*b* of the post 14. The bearings 42 and 44 provide adjacent bearing surfaces that are respectively parallel to the adjacent post end faces 12*b* and 14*b*.

Figure 4:
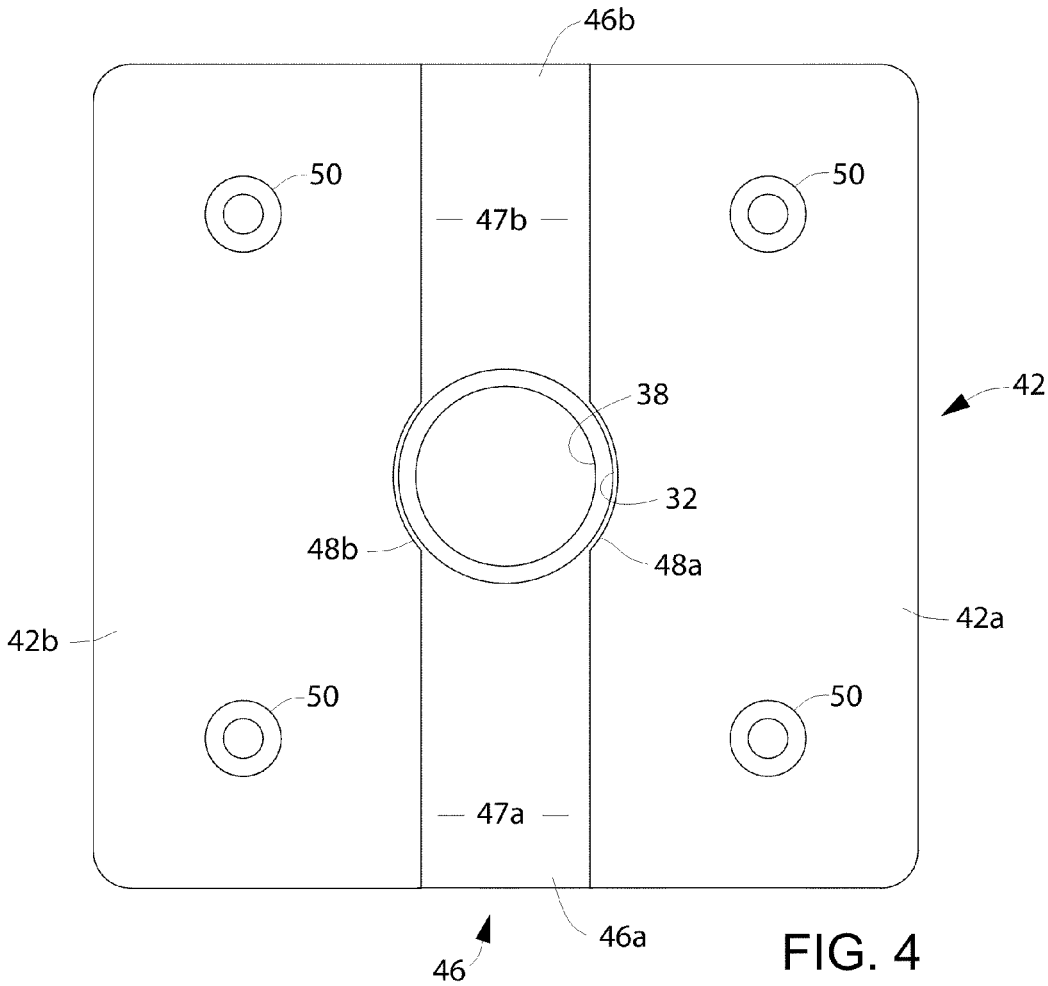
FIG. 4 is a plan view of a lower bearing member to be mounted to the connecting end of the lower post.
Figure 6:
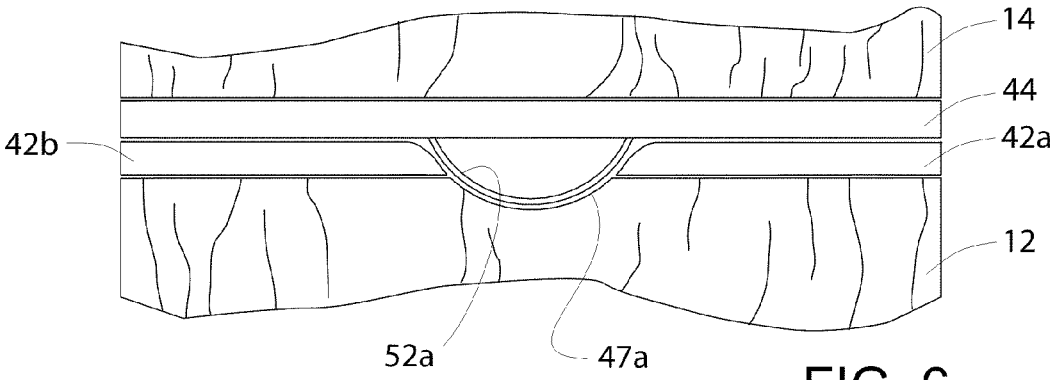
FIG. 6 is a schematic fragmentary sectional view showing the bearing and detent assembly of FIG. 1 joining the lower and upper posts.

Referring to FIG. 4, the bearing 42 is formed by a pair of bearing plates 42*a* and 42*b* positioned on each side of the mounting bore 32 and a recess 46. As shown, the recess 46 includes recess portions 46*a* and 46*b* positioned on opposite sides of the bore 32. The recess 46 extends into the end face 12*b* of the post 12 and across the width of the post as shown in FIGS. 4 and 6.

Each of the recess portions 46*a* and 46*b* is about 1⅝" wide and about 1⅞" long. The recess has a semi-cylindrical cross-section and extends through the thickness of the bearing plates 42*a* and 42*b* to arcuate recess bottom portions 47*a* and 47*b* (FIG. 4) formed in the end face 12*a* of the post 12 adjacent the recess portions 46*a* and 46*b*. Accordingly, the recess 46 is formed in-part by the bearing 42 and the connecting end 12*a*. The bearing 42 may be provided with a greater thickness and the recess 46 may be formed entirely within the bearing thickness.

The bearing plates 42*a* and 42*b* are shaped to correspond with the outer periphery of the end face 12*b* and to extend inwardly to the recess 46 and arcuate openings 48*a* and 48*b* surrounding the bore 32 for through passage of the shaft 38. In this manner, substantially the entire end face 12*b* of the post 12 is covered by the bearing 42 remote of the recess 46 for full support and bearing engagement with the bearing 44. The bearing plates 42*a* and 42*b* are formed of ¼ inch thick steel, but other materials may be used.

As shown in FIG. 4, four mounting holes 50 are provided in the bearing plates 42*a* and 42*b* at the corners of the post 12 for receipt of screws or other fasteners to secure the bearing plates to the post. The holes 50 are preferably countersunk to allow flat surface engagement and to allow frictionally smooth rotational movement along the bearing face.

Figure 5:
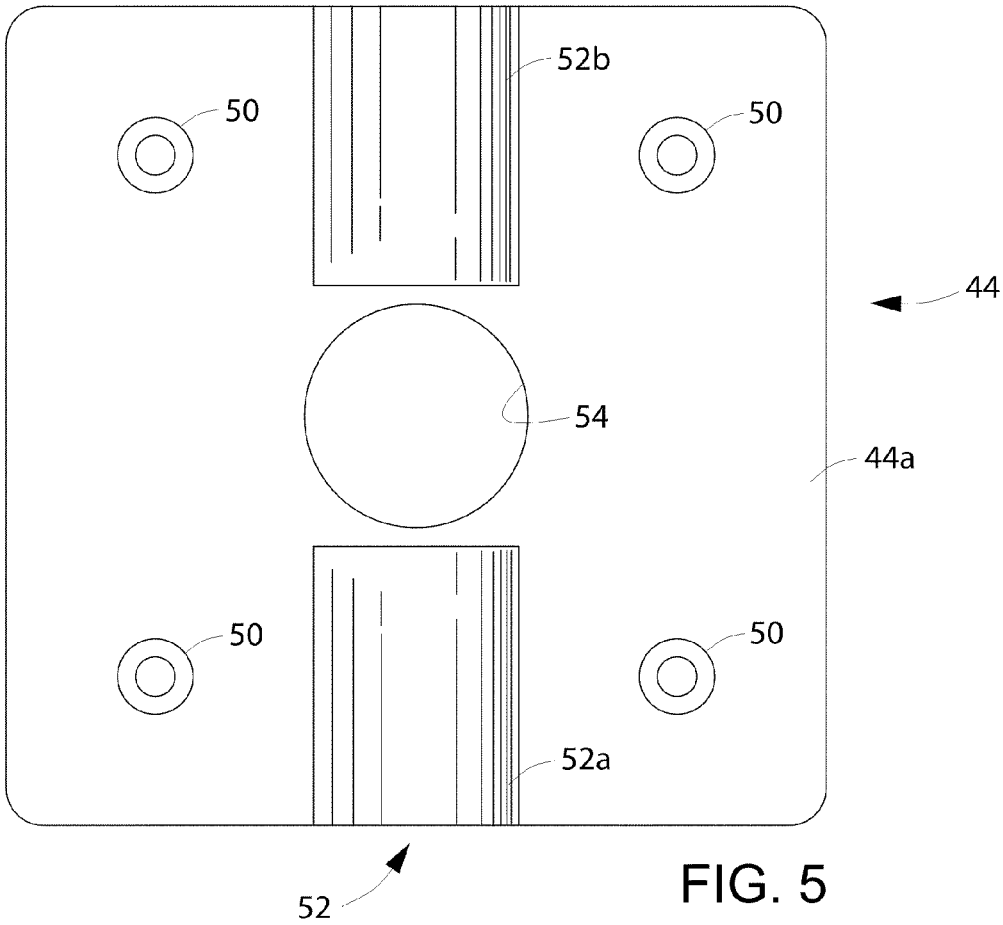
FIG. 5 is a plan view of an upper bearing member to be mounted to the connecting end of the upper post.

Referring to FIG. 5, the bearing 44 is formed as a single bearing plate 44*a* shaped to correspond with the outer periphery of the end face 14*b*, extending inwardly to a projection 52 and to a mounting bore 54 surrounding the bore 34 for through passage of the shaft 38. In this manner, substantially the entire end face 14*b* of the post 14 is covered by the bearing 44 remote of the projection 52 and the bore 54 for full support and bearing engagement with the bearing 42. It is convenient to also form the bearing plate 44*a* of ¼ inch thick steel, but other materials may be used.

The projection 52 is formed by an aligned pair of projection portions 52*a* and 52*b* that are each about 1⅝" wide and about 1⅞" long. Thus, the projection portions 52*a* and 52*b* are sized to be received in the recess portions 46*a* and 46*b*. The projection height corresponds with the depth of the recess 46 and it is provided with a similar semi-cylindrical cross-section. Accordingly, the projection 52 extends through the thickness of the bearing plates 42*a* and 42*b* and into the arcuate recess bottom portions 47*a* and 47*b* formed in the end face 12*a* of the post 12 adjacent the recess portions 46*a* and 46*b*.

As shown in FIG. 5, four mounting holes 50 are also provided in the bearing plate 44*a* at the corners of the post 14 for receipt of screws or other fasteners to secure the bearing plate to the post. The holes 50 are preferably countersunk to allow flat surface engagement and to allow frictionally smooth rotational movement along the bearing face.

It should be appreciated that the depth and semi-cylindrical cross-sectional shapes of the projection 52 and the recess 46 cooperate to determine the resistance to rotation of the upper post 14. That is, the horizontal load or force required to swing away or pivot the support arm 16 about the shaft 38 is primarily determined by the depth and shape of the projection 52 and recess 46. Thus, the projection 52 and the recess 46 may be configured to provide a desired resistance to swing away or pivotal movement in accordance with the weight of the upper members.

The projection 52 and recess 46 are provided with smoothly rounded engaging edges to cooperatively provide a cam function to lift the upper post 14 as it is rotated. The projections 52*a* and 52*b* are lifted from the recesses 46*a* and 46*b* as rotation of the post 14 begins and the projections 52*a* and 52*b* then travel across the bearing plates 42*a* and 42*b* with continued rotation.

In the illustrated embodiment, the projection 52 will rotate 180° before again entering the recess 46. Depending upon the horizontal/rotational load imposed on the post 14, rotation may continue with the projection 52 once again working to cam itself out of the recess 46 and again lifting the post 14. Following the rotation of the post 14, the post 14 may again be rotated back to the aligned position with the mailbox 24 adjacent to and facing the road edge.

It should be appreciated that the shaft 38 is sized to closely fit in the bores 32, 34 and 36 to inhibit irregular rotation. Similarly, the arcuate openings 48*a*, 48*b* in the bearing 42 and the bore 44 in the bearing 44 are sized to closely fit the shaft 38 in order to avoid wobble during rotation. For example, 1/16" clearance may be used for a 1.5" shaft O.D.

Figure 7:
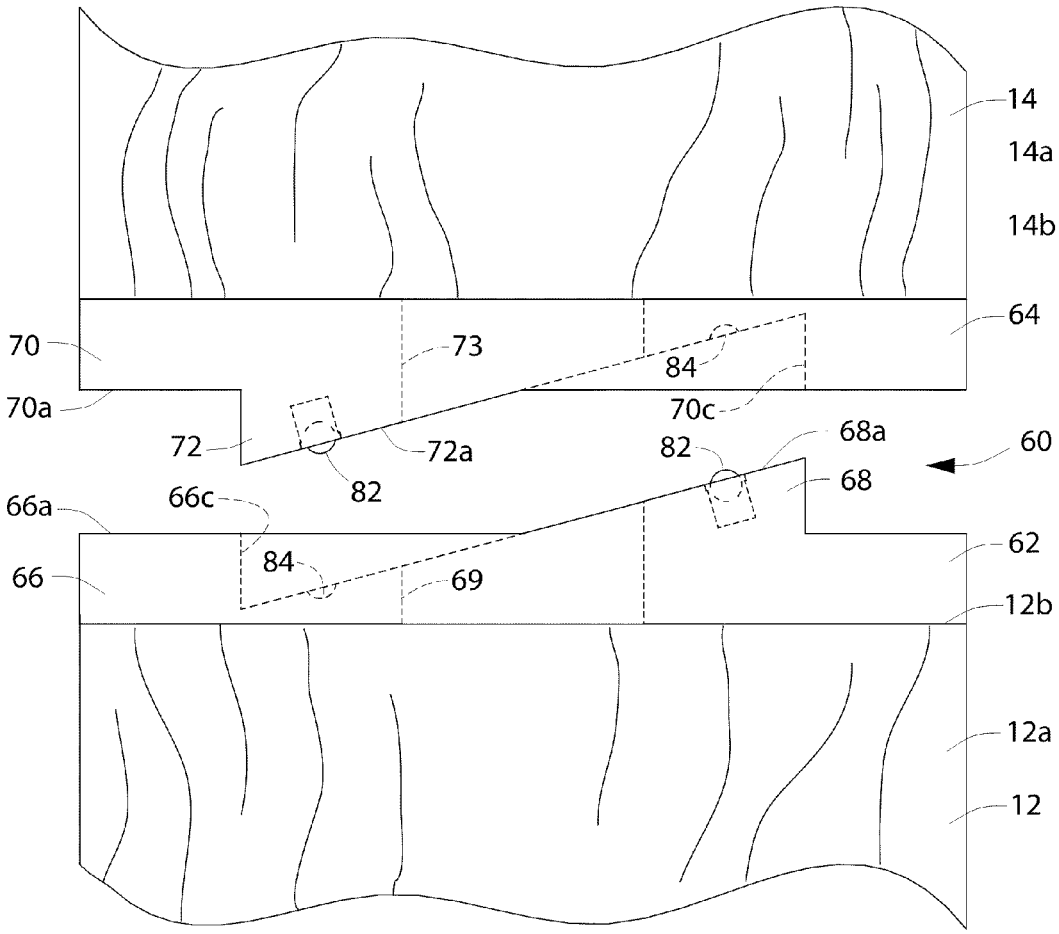
FIG. 7 is a fragmentary sectional view similar to FIG. 6 showing another embodiment of the bearing and detent assembly including bearing members in accordance with the invention.
Figure 8:
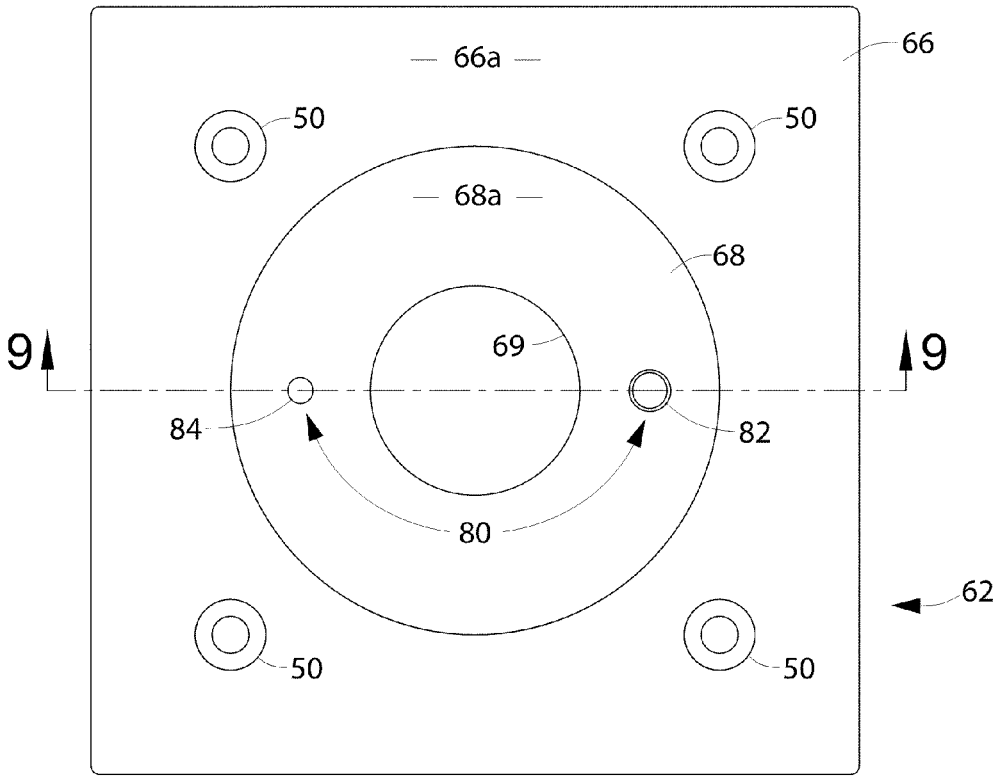
FIG. 8 is a plan view of one of the bearing members shown in FIG. 7.
Figure 9:
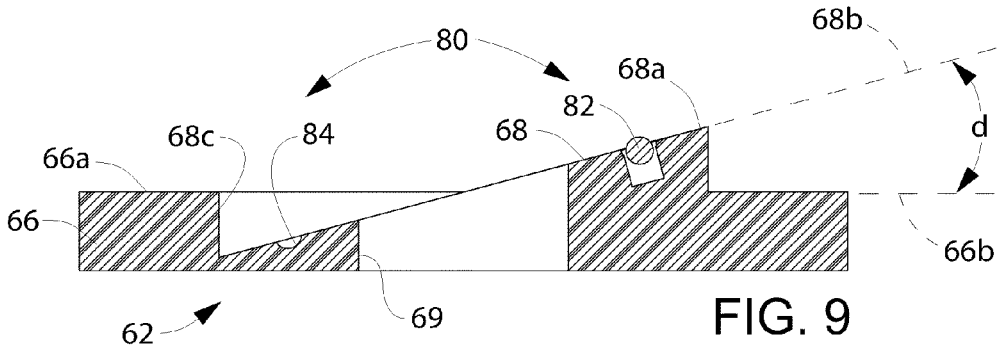
FIG. 9 is a sectional view of the bearing member of FIG. 8 taken along the line 9-9.

Referring to FIGS. 7, 8 and 9, a bearing and detent assembly 60 is shown mounted to the connecting ends 12*a* and 14*a* of the posts 12 and 14. The assembly 60 includes lower and upper bearing members 62 and 64.

The bearings 62 and 64 are each shaped and sized to correspond with the shape and area of the connecting end 12*a* or 14*a* to which they are mounted. The connecting ends 12*a* and 14*a* are similarly sized, often formed by a perpendicular cut in a single post, and the bearings 62, 64 are also of similar size and may be of identical construction as in the illustrated assembly.

The bearing 62 has a peripheral bearing portion 66 surrounding a circular bearing portion 68 including an opening 69 for receipt of the shaft 38. The peripheral bearing portion 66 includes a cam surface 66*a* and circular portion 68 includes a cam surface 68*a*.

As indicated, the bearing 64 is similarly shaped and has a peripheral bearing portion 70 surrounding a circular bearing portion 72 including an opening 73 for receipt of the shaft 38. The peripheral bearing portion 70 includes a cam surface 70*a* and the circular portion 72 includes a cam surface 72*a*.

The bearings 62 and 64 are identical, and the specific geometry of the bearing 62 is described below, it being understood that the bearing 64 is identical.

The cam surface 66*a* of the peripheral bearing portion 66 extends in a plane indicated by the line 66*b* that is parallel to the plane of the adjacent connecting end face 12*b*. The cam surface 68*a* of the circular bearing portion 68 extends in a cam plane indicated by the line 68*b*. The plane of the cam surface 68*a* of the circular bearing portion 68 intersects the plane of the cam surface 66*a* of the peripheral bearing surface 66 at an angle indicated by a in FIG. 9. As shown, the angle α has a value of about 10 degrees and it may range in value from about 5 degrees to about 30 degrees.

The circular portion 68 extends below and above the peripheral cam surface 66*a* as best shown in FIGS. 7 and 9. That is, a section of circular portion 68 projects above the cam surface 66*a* and the remaining section of the circular portion 68 extends below the cam surface 66*a* to form a recess 66*c*. More particularly, one-half of the area of the circular portion 68 is below the cam surface 66*a* so that a semi-circular recess 66*c* is formed in the bearing surface 66*a* for receipt of the projecting circular section of the circular portion 72. Similarly, a semi-circular recess 70*c* is formed in the cam surface 70*a*. In this manner, all of the projecting portion of each circular portion is received in and substantially fills the recess formed in the other projection portion.

In this embodiment, the circular portions 68 and 72 provide cam and support surfaces as well as a locking detent function. More particularly, in a locking or detent-engaged stable position tending to resist rotation, the circular portions 68 and 72 are nested and the cam surfaces 68*a* and 72*a* fully contact each other along their adjacent areas or extents. At the same time, the peripheral cam surfaces 66*a* and 70*a* are fully engaged to provide increased support and stability.

Upon rotation, the cam surfaces 68*a* and 72*a* operate to lift the upper post 14 and the peripheral cam surfaces 66*a* and 70*a* are moved apart or vertically spaced in accordance with the angle of the cam surfaces 68*a* and 72*a*. This is not a stable position and the upper post 14 has a tendency to continue rotation and the circular portions 68 and 72 tend to return to their nested position with the cam surfaces 68*a* and 72*a* fully engaged.

A supplemental detent or lock system 80 may be provided by a resiliently projecting button 82 and radially aligned circular recess 84 provided in each of the circular portions 68 and 72. As shown in the drawings, when circular portions 68, 72 are nested they are 180 degrees offset and the button 82 on one of the circular portions is received in the recess 84 in the other of the circular portions. This increases the stability of the bearing and detent system 60.

Figure 10:
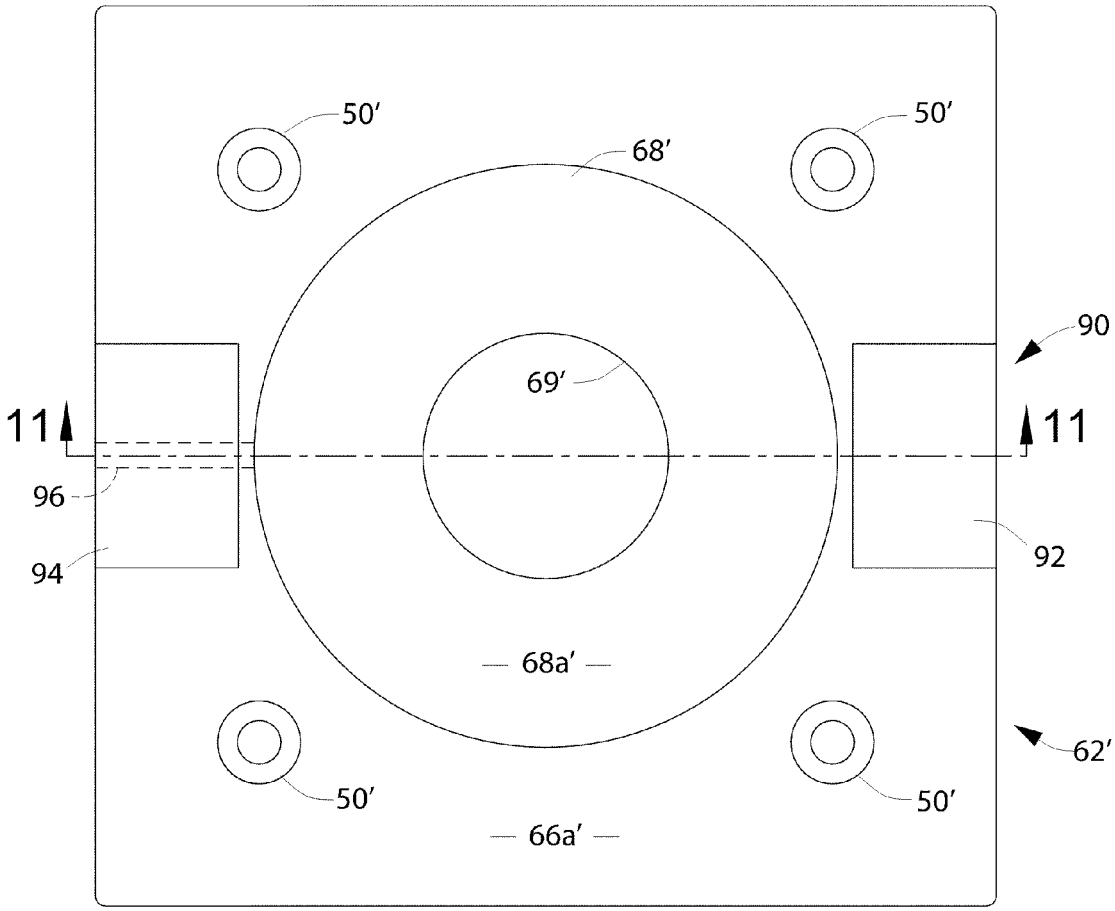
FIG. 10 is a plan view of a modified bearing member having a rod and recess detent arrangement.
Figure 11:
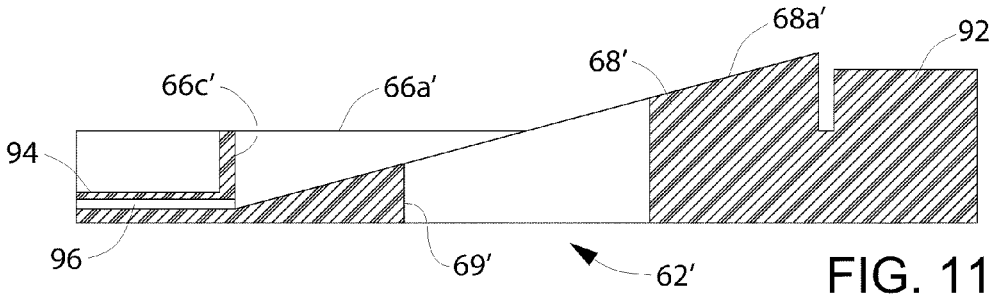
FIG. 11 is a sectional view of the bearing member of FIG. 10 taken along the line 11-11.

Referring to FIGS. 10 and 11, a bearing member 62' for use in a modified detent and bearing assembly (not shown) is illustrated with the addition of a prime designation to reference numerals of corresponding parts. A similar bearing member 64' (not shown) is provided to complete the bearing and detent assembly in this embodiment.

The bearing member 62' includes a supplemental detent or lock system 90. The system 90 comprises a rib projection 92 and a recess 94 located in the peripheral bearing portion 66' of the lower bearing member 62'. A mating upper bearing 64' (not shown) is provided with a corresponding rib projection 92 and recess 94 radially located for engagement when the circular bearing portion 68' is nested within the circular bearing portion 72' (not shown).

The rib projection 92 operates with the recess 94 to cam the upper post 14 in an upward direction as the rib moves out of the recess and onto the cam surface 66*a*'. As shown in FIG. 11, the circular bearing portion 68' should project further from the cam surface 66*a*' than the rib projection 92 so that the latter determines the resistance to rotation.

The rib projection 92 and the recess 94 are provided with smoothly curved cross-sections to facilitate engagement and disengagement during relative rotation of the posts. Accordingly, rotational movement of the upper post portion is smooth.

As shown in FIGS. 10 and 11, a weep hole 96 may be provided to drain moisture from the recess 66*c*'. Drainage of such moisture will tend to inhibit frost and freeze damage.

The bearing and detent assembly 40 or 60 and, optionally, the shaft 38 as well as the arm 16 may be sold as a kit to retrofit an existing non-rotational mailbox support structure. Alternatively, all or some of the post components may be included in the kit.

If an existing mailbox support includes a post construction, the upright post may be horizontally cut below the mailbox support arm. In this manner, lower and upper posts are provided extending to connecting ends to be rejoined using the kit components. That is, suitable mounting bores or central openings may be provided in the connecting ends of the posts to receive the connecting shaft. The lower bearing may be fixed to the top of the lower post and the upper bearing may be fixed to the bottom of the upper post.

What is claimed is:

1. A pivotable mailbox support including lower and upper posts arranged for connection along a mounting axis, an angularly projecting mailbox support arm fixed to said upper post;

said lower post including a ground anchor end and extending to a first connecting end having a first bore extending along said mounting axis;

said upper post extending to a second connecting end and having a second bore extending along said mounting axis, said second bore being axially aligned with said first bore when said upper post is mounted to said lower post;

a shaft disposed within said first and second bores to mount said posts together, said upper post being rotatable about said shaft; and a bearing and detent assembly mounted to said first and second connecting ends, said assembly including a plurality of bearing members secured to said first and second connecting ends providing opposed flat bearing surfaces for supporting said mounted posts, said bearing members including bearing openings aligned with said bores, said shaft extending within said bores and through said bearing openings, and projection means being received in recess means to temporarily fix the rotational position of said posts about said mounting axis, said projection means disengaging from said recess means upon rotation of said upper post and sliding along said flat bearing surface.

2. The mailbox support of claim 1, wherein said first and second connecting ends respectively include first and second end faces, and said flat bearing surfaces together with said projection means and recess means are substantially coextensive with said end faces.

3. The mailbox support of claim 2, wherein said lower post is anchored in the ground with said mounting axis extending in a vertical direction and said upper post is rotatable in response to horizontal force applied to said mailbox support arm.

4. The mailbox support of claim 3, wherein a bumper is mounted to said mailbox support arm and extends horizontally beyond said mailbox supporting arm.

5. The mailbox support of claim 1, wherein said projection means include at least one projection extending away from one of said bearing members and said recess is formed at least in-part by another of said bearing members.

6. The mailbox of claim 5, wherein said projection comprises a rod-shape member extending radially away from said bearing openings and projecting from said bearing surface to a smoothly rounded end cross-section, said recess means include an elongate recess radially extending away from said bearing openings and having a smoothly rounded semi-cylindrical cross-section for receipt of said rod-shape member.

7. The mailbox support of claim 1, wherein said plurality of bearing members comprise first and second bearing members including first and second peripheral bearing portions surrounding first and second circular bearing portions, each of said peripheral bearing portions having a peripheral cam surface extending in plane parallel to an end face of the adjacent post connecting end, said circular portions each having a circular portion cam surface that intersects said peripheral cam surface at an angle.

8. The mailbox support of claim 7, wherein said bearing members are relatively rotated to dispose said first and second circular portions in an aligned position with the circular portions nested and the circular portion cam surfaces in full contact.

9. The mailbox support of claim 8, wherein said first and second circular portions each include a recessed section extending below said peripheral bearing surface and a projecting section extending above said peripheral bearing surface.

10. The mailbox support of claim 9, wherein said circular portion cam surface intersects said peripheral cam surface at said angle which is between about 5 degrees and about 30 degrees.

11. The mailbox support of claim 7, wherein said projection means include at least one projection extending away from one of said bearing members and a recess formed in the other of said bearing members.

12. The mailbox support of claim 11, wherein projection means includes a projecting rib extending away from one of said peripheral bearing portions and a recess formed in the other of said peripheral bearing portions.

13. The mailbox support of claim 11, wherein said projection means and recess means are provided in said circular portions, said projection means includes a projection extending away from one of said circular portions, and said recess means includes a recess formed in the other of said circular portions.

14. The mailbox support of claim 7, wherein each of said first and second bearing members is formed of a single piece of material.

15. A pivotable mailbox support including lower and upper posts arranged for connection along a mounting axis, an angularly projecting mailbox support arm fixed to said upper post;

said lower post including a ground anchor end and extending to a first connecting end having a first bore extending along said mounting axis;

said upper post extending a second connecting end and having a second bore extending along said mounting axis, said second bore being axially aligned with said first bore when said upper post is mounted to said lower post;

a shaft disposed within said first and second bores to mount said posts together, said upper post being rotatable about said shaft; and a bearing and detent assembly mounted to said first and second connecting ends, said assembly comprising first and second bearing members including first and second peripheral bearing portions surrounding first and second circular bearing portions, each of said peripheral bearing portions extending in a post plane parallel to the adjacent connecting end, said circular portions each extending in a cam plane that intersects said post plane at an angle.

16. The mailbox support of claim 15, wherein said first and second circular portions each include a recessed section extending below said peripheral bearing surface and a projecting section extending above said peripheral bearing surface.

17. The mailbox support of claim 16, wherein said cam plane intersects said post plane at said angle which is between about 5 degrees and about 30 degrees.

18. A kit for modification of a stationary mailbox support having a vertical post and a generally horizontally extending mailbox support arm, wherein said vertical post is horizontally cut to form upper and lower posts extending to connecting ends and axially aligned central bores are provided in said connecting ends, said kit comprising:

a bearing and detent assembly mountable to said first and second connecting ends, and a shaft sized to be tightly received in said bores;

said bearing and detent assembly including a plurality of bearing members having engageable opposable flat bearing surfaces for supporting said mounted posts when said bearing members are secured to said connecting ends, said bearing members including bearing openings aligned with said bores, and projection means being received in recess means to temporarily fix the rotational position of said posts about said mounting axis, said projection means disengaging from said recess means upon rotation of said upper post and sliding along said flat bearing surface.

19. The kit of claim 18, wherein said plurality of bearing members comprise first and second bearing members including first and second peripheral bearing portions surrounding first and second circular bearing portions, each of said peripheral bearing portions extending in a post plane parallel to the adjacent connecting end, said circular portions each extending in a cam plane that intersects said post plane an angle.

20. The kit of claim 19, wherein said first and second circular portions each include a recessed section extending below said peripheral bearing surface and a projecting section extending above said peripheral bearing surface.

* * * * *